US011098442B2

(12) United States Patent
Kanayama et al.

(10) Patent No.: US 11,098,442 B2
(45) Date of Patent: Aug. 24, 2021

(54) WATER-REPELLENT KNITTED FABRIC, METHOD FOR PRODUCING WATER-REPELLENT KNITTED FABRIC, CLOTHING MADE OF WATER-REPELLENT KNITTED FABRIC, AND LAYERING INCLUDING CLOTHING

(71) Applicants: finetrack co., ltd., Kobe (JP); UNITIKA TRADING CO., LTD., Osaka (JP)

(72) Inventors: Yotaro Kanayama, Kobe (JP); Yuko Yagi, Osaka (JP); Jun Tanaka, Tokyo (JP)

(73) Assignees: finetrack co., ltd., Kobe (JP); UNITIKA TRADING CO., LTD., Osaka (JP)

( * ) Notice: Subject to any disclaimer, the term of this patent is extended or adjusted under 35 U.S.C. 154(b) by 0 days.

(21) Appl. No.: 17/107,869

(22) Filed: Nov. 30, 2020

(65) Prior Publication Data

US 2021/0164135 A1 Jun. 3, 2021

(30) Foreign Application Priority Data

Dec. 3, 2019 (JP) ..... JP2019-218483

(51) Int. Cl.
*D06M 15/256* (2006.01)
*A41D 31/10* (2019.01)
(Continued)

(52) U.S. Cl.
CPC ..... *D06M 15/256* (2013.01); *A41D 31/10* (2019.02); *D04B 1/16* (2013.01); *D04B 1/24* (2013.01);
(Continued)

(58) Field of Classification Search
None
See application file for complete search history.

(56) References Cited

U.S. PATENT DOCUMENTS

2005/0075027 A1* 4/2005 Etchells ..... B32B 5/147 442/205

FOREIGN PATENT DOCUMENTS

EP 3354777 A1 8/2018
JP 61-167088 A 7/1986
(Continued)

OTHER PUBLICATIONS

Complete Textile Glossary, Celanese Acetate LLC., 2001.*
(Continued)

*Primary Examiner* — Jennifer A Gillett
(74) *Attorney, Agent, or Firm* — Knobbe, Martens, Olson & Bear, LLP

(57) ABSTRACT

A water-repellent knitted fabric is a knitted fabric which comprises a multifilament made of a thermoplastic resin and has a water repellent imparted to a surface of the knitted fabric or the multifilament, and satisfies the following conditions (1) to (4):

(1) the number of voids between stitches of the knitted fabric is 20 to 40/[12 cm×12 cm], and the voids have a size of 7 to 25 $mm^2$;
(2) initial water repellency measured in accordance with a spray method described in JIS L-1092 is at a grade 3 or higher;
(3) initial Water drainage is 70% or more; and
(4) initial Bursting Strength measured in accordance with a method A described in JIS L-1096 is 200 kPa or more and 500 kPa or less.

9 Claims, 7 Drawing Sheets

(51) Int. Cl.

| | |
|---|---|
| ***D04B 1/16*** | (2006.01) |
| ***D04B 1/24*** | (2006.01) |
| ***D04B 21/20*** | (2006.01) |

(52) U.S. Cl.

CPC ..... *D04B 21/207* (2013.01); *A41D 2500/10* (2013.01); *D06M 2200/10* (2013.01); *D10B 2401/021* (2013.01); *D10B 2403/02* (2013.01); *D10B 2501/00* (2013.01); *Y10T 442/10* (2015.04); *Y10T 442/2238* (2015.04)

(56) References Cited

FOREIGN PATENT DOCUMENTS

| | | | | |
|---|---|---|---|---|
| JP | 9-195172 | A | | 7/1997 |
| JP | 2000-256948 | A | | 9/2000 |
| JP | 2006111984 | A | * | 4/2006 |
| JP | 2009-299201 | A | | 12/2009 |
| JP | 2009-299207 | A | | 12/2009 |
| JP | 4384959 | B | | 12/2009 |
| JP | 2014-198924 | A | | 10/2014 |
| JP | 2015-193940 | A | | 11/2015 |
| JP | 2018197403 | A | * | 12/2018 |
| WO | 2017/217484 | A1 | | 12/2017 |

OTHER PUBLICATIONS

English Machine Translation of JP 2006-111984, IP.com, retrieved Feb. 9, 2021.*

English Machine Translation of JP 2018-197403, IP.com, retrieved Feb. 24, 2021.*

* cited by examiner

Fig.3A

| | yarn type | mixing ratio | processing |
|---|---|---|---|
| Example 1 | false-twisted yarn of Lumiace 73T44 | polyester 100% | scouring→dyeing and water absorption →water repellent →post-treatment |
| Example 2 | false-twisted yarn of Lumiace 73T44 | polyester 100% | scouring→dyeing and water absorption →water repellent →post-treatment |
| Example 3 | False twisted yarn consisting of filaments of fibers having both a triangular cross section and a cross section 78T48 | 100% polyester | scouring→dyeing and water absorption →water repellent →post-treatment |
| Example 4 | False twisted yarn with a circular cross section 84T72 | 100% polyester | scouring→dyeing→water repellent →post-treatment |
| Example 5 | false-twisted yarn of Lumiace 73T44 | 100% polyester | scouring→dyeing→water repellent( double amounts) → post-treatment |
| Example 6 | false-twisted yarn of Lumiace UV 84T48 | 100% polyester | scouring→dyeing and water absorption →water repellent →post-treatment |
| Example 7 | Mixed fiber yarn with Lumiace 73T44 and triangular cross-section yarn 92T70 | 100% polyester | scouring→dyeing and water absorption →water repellent →post-treatment |
| Example 8 | Nylon circular cross-section thread 33T26, polyurethane 78T1 | 88% nylon, 16% polyurethane | scouring→dyeing→water repellent →post-treatment |
| Example 9 | false-twisted yarn of Lumiace 73T44 | 100% polyester | scouring→dyeing→water repellent →post-treatment |
| Comparative example 1 | false-twisted yarn of Lumiace 73T44 | 100% polyester | scouring→dyeing and water absorption →water repellent →post-treatment |
| Comparative example 2 | false-twisted yarn of Lumiace 73T44 | 100% polyester | scouring→dyeing and water absorption →water repellent →post-treatment |
| Comparative example 3 | Nylon circular cross-section thread 33T26, polyurethane 78T1 | 88% nylon, 16% polyurethane | scouring→dyeing→water repellent →post-treatment |
| Comparative example 4 | false-twisted yarn of Lumiace 73T44 | 100% polyester | scouring→dyeing→water repellent →post-treatment |
| Comparative example 5 | Mixed yarn with False twisted yarn with a circular cross section 110T48 and False twisted yarn with a circular cross section 44T48 | 100% polyester | scouring→dyeing→water repellent →post-treatment |

Fig.3B

| | Knitting structure | weight per unit area (g/m²) | Knitting density | Void size mm² | Number of voids 12cmx12cm | Water repellency | | | |
|---|---|---|---|---|---|---|---|---|---|
| | | | | | | initial | HL100 | HL120 | HL150 |
| Example 1 | Mesh structure | 55 | 32C/25W | 20.4 | 30 | 4 | 3 | 3 | 3 |
| Example 2 | Mesh structure | 50 | 32C/23W | 17.3 | 32 | 4 | 3 | 3 | 3 |
| Example 3 | Mesh structure | 60 | 32C/23W | 23.0 | 32 | 4 | 3 | 3 | 3 |
| Example 4 | Mesh structure | 75 | 32C/25W | 20.4 | 30 | 4 | 3 | 3 | 2 |
| Example 5 | Mesh structure | 55 | 33C/24W | 20.4 | 31 | 4 | 3 | 3 | 2 |
| Example 6 | Mesh structure | 75 | 32C/25W | 20.4 | 30 | 4 | 3 | 3 | 3 |
| Example 7 | Mesh structure | 70 | 32C/23W | 23.0 | 32 | 4 | 3 | 3 | 3 |
| Example 8 | Mesh structure | 95 | 75C/52W | 7.9 | 23 | 4 | 3 | 3 | 2 |
| Example 9 | Mesh structure | 55 | 33C/23W | 15.1 | 33 | 4 | 3 | 2 | 2 |
| Comparative example 1 | Mesh structure | 90 | 67C/19W | 6.4 | 52 | 4 | 3 | 3 | 3 |
| Comparative example 2 | Mesh structure | 40 | 37C/15W | 34.6 | 25 | 4 | 3 | 3 | 3 |
| Comparative example 3 | Mesh structure | 95 | 75C/52W | 9.4 | 12 | 4 | 3 | 3 | 2 |
| Comparative example 4 | Mesh structure | 70 | 52C/30W | 11.8 | 60 | 4 | 3 | 2 | 2 |
| Comparative example 5 | Mesh structure | 240 | 32C/49W | 75.3 | 35 | 3 | 3 | 2 | 2 |

Fig.3C

| | Bending Characteristics (initial) | | Bending Characteristics (after HL120) | | Rate of change of value(%) | |
|---|---|---|---|---|---|---|
| | B (gf·cm²/cm) | 2HB (gf·cm/cm) | B (gf·cm²/cm) | 2HB (gf·cm/cm) | B (gf·cm²/cm) | 2HB (gf·cm/cm) |
| Example 1 | 0.0142 | 0.0056 | 0.0042 | 0.0097 | -70.4 | 73.2 |
| Example 2 | 0.0216 | 0.0059 | 0.0100 | 0.0090 | -53.7 | 53.2 |
| Example 3 | 0.0202 | 0.0051 | 0.0099 | 0.0072 | -51.0 | 43.5 |
| Example 4 | 0.0210 | 0.0061 | 0.0105 | 0.0088 | -50.0 | 44.3 |
| Example 5 | 0.0223 | 0.0067 | 0.0104 | 0.0111 | -53.4 | 65.3 |
| Example 6 | 0.0184 | 0.0057 | 0.0083 | 0.0098 | -54.8 | 72.5 |
| Example 7 | 0.0220 | 0.0052 | 0.0107 | 0.0085 | -51.3 | 64.2 |
| Example 8 | 0.0021 | 0.0050 | 0.0018 | 0.0045 | -14.3 | -9.1 |
| Example 9 | 0.0060 | 0.0048 | 0.0030 | 0.0068 | -49.9 | 43.7 |
| Comparative example 1 | 0.0391 | 0.0130 | 0.0230 | 0.0215 | -41.2 | 65.7 |
| Comparative example 2 | 0.0103 | 0.0041 | 0.0057 | 0.0067 | -44.7 | 65.4 |
| Comparative example 3 | 0.0022 | 0.0049 | 0.0019 | 0.0044 | -13.6 | -10.2 |
| Comparative example 4 | 0.2467 | 0.0056 | 0.0900 | 0.0087 | -63.5 | 57.6 |
| Comparative example 5 | 0.0464 | 0.0715 | 0.0415 | 0.0792 | -10.4 | 10.8 |

Fig.3D

| | surface characteristics (initial) | | surface characteristics (after HL120) | | Rate of change of value(%) | |
|---|---|---|---|---|---|---|
| | MIU | MMD | MIU | MMD | MIU | MMD |
| Example 1 | 0.196 | 0.0160 | 0.206 | 0.0176 | 4.9 | 10.1 |
| Example 2 | 0.199 | 0.0150 | 0.207 | 0.0167 | 4.2 | 11.5 |
| Example 3 | 0.203 | 0.0159 | 0.213 | 0.0174 | 4.8 | 9.4 |
| Example 4 | 0.187 | 0.0148 | 0.195 | 0.0156 | 4.3 | 5.4 |
| Example 5 | 0.207 | 0.0241 | 0.217 | 0.0265 | 5.0 | 9.8 |
| Example 6 | 0.188 | 0.0110 | 0.197 | 0.0121 | 4.7 | 10.2 |
| Example 7 | 0.211 | 0.0240 | 0.220 | 0.0268 | 4.5 | 11.8 |
| Example 8 | 0.172 | 0.0592 | 0.196 | 0.0761 | 14.0 | 28.5 |
| Example 9 | 0.200 | 0.0159 | 0.211 | 0.0181 | 5.5 | 13.8 |
| Comparative example 1 | 0.223 | 0.0300 | 0.227 | 0.0320 | 1.6 | 6.6 |
| Comparative example 2 | 0.184 | 0.0175 | 0.195 | 0.0201 | 6.1 | 14.6 |
| Comparative example 3 | 0.178 | 0.0603 | 0.188 | 0.0734 | 5.6 | 21.7 |
| Comparative example 4 | 0.182 | 0.0157 | 0.190 | 0.0172 | 4.4 | 9.8 |
| Comparative example 5 | 0.425 | 0.0270 | 0.444 | 0.0352 | 4.5 | 30.4 |

Fig.3E

| | Sensory evaluation of texture | | wet-pick-up rate (%) | Amount of water repellent attached (g/m²) | Water drainage (%) | Bursting Strength (kPa) | Thickness (μm) |
|---|---|---|---|---|---|---|---|
| | Gentle texture | smooth texture | | | | | |
| Example 1 | 4.0 | 4.0 | 175.2 | 1.7 | 86.2 | 303 | 500 |
| Example 2 | 3.6 | 3.6 | 169.9 | 1.5 | 85.4 | 307 | 480 |
| Example 3 | 3.4 | 3.8 | 173.7 | 1.9 | 84.1 | 290 | 470 |
| Example 4 | 3.4 | 3.4 | 165.3 | 2.2 | 75.4 | 270 | 500 |
| Example 5 | 3.2 | 4.0 | 178.1 | 3.5 | 79.0 | 273 | 490 |
| Example 6 | 3.8 | 3.2 | 177.4 | 2.4 | 77.2 | 279 | 530 |
| Example 7 | 3.4 | 3.6 | 171.2 | 2.2 | 84.5 | 315 | 570 |
| Example 8 | 4.0 | 4.0 | 160.4 | 2.7 | 90.0 | 203 | 320 |
| Example 9 | 3.8 | 3.8 | 172.2 | 1.7 | 75.7 | 292 | 490 |
| Comparative example 1 | 0.7 | 2.0 | 167.4 | 2.7 | 64.8 | 323 | 730 |
| Comparative example 2 | 4.0 | 2.0 | 142.9 | 1.0 | 95.3 | 153 | 370 |
| Comparative example 3 | 4.0 | 4.0 | 162.9 | 2.8 | 69.3 | 210 | 320 |
| Comparative example 4 | 4.0 | 4.0 | 165.8 | 2.1 | 68.1 | 353 | 380 |
| Comparative example 5 | 0.0 | 0.0 | 220.4 | 9.5 | 84.6 | 530 | 1350 |

WATER-REPELLENT KNITTED FABRIC, METHOD FOR PRODUCING WATER-REPELLENT KNITTED FABRIC, CLOTHING MADE OF WATER-REPELLENT KNITTED FABRIC, AND LAYERING INCLUDING CLOTHING

TECHNICAL FIELD

The present invention relates to a water-repellent knitted fabric, a method for producing a water-repellent knitted fabric, clothing made of the water-repellent knitted fabric, and layering including the clothing.

BACKGROUND ART

As a water-repellent knitted fabric that retains waterproofness and water repellency, has appropriate breathability, is unlikely to be stuffy and sticky even in raining or sweating, and does not cling to the skin, Patent Literature 1 describes a knitted fabric knitted to have at least a surface thereof covered by a crimping fiber of a false twisted crimped yarn having a single yarn denier of 0.2 to 3.0, and a number of crimps of 3 to 45%. The knitted fabric is knitted with a high gauge of 28 or more gauges and hence has a high density, and the surface of the knitted fabric is subjected to water-repellent processing to have a water pressure resistance of 150 mm or more.

Patent Literature 2 describes a knitted fabric having a weight of 380 to 550 g/160 cm width and having merely one surface thereof subjected to breathable water-repellent processing that does not penetrate the other surface, is permanent, and has excellent launderability.

Patent Literature 3 describes a knitted fabric for clothing in which loop pile is formed on a surface of a rear layer, and a water-repellent thread is disposed merely on the rear layer, and thus, a large amount of sweat is collected on a side of the outside air in the knitted fabric for drying the fabric early by accelerating transpiration of the sweat to the outside air.

Patent Literature 4 describes auxiliary clothing to be worn under hygroscopic or water-absorptive clothing in direct contact with the skin. The auxiliary clothing is made of a water-repellent finished knitted fabric, and the knitted fabric is formed by any one of knitting methods of circular rib knitting, plain knitting, tricot knitting, and mesh knitting, and therefore, sweat is absorbed by the clothing through stitches of the water-repellent finished knitted fabric, so that a moisture of the clothing is blocked by the water-repellent finished knitted fabric and does not move to the skin.

CITATION LIST

Patent Literature

[Patent Literature 1] Japanese Patent Laid-Open No. 2000-256948

[Patent Literature 2] Japanese Patent Laid-Open No. 61-167088

[Patent Literature 3] Japanese Patent Laid-Open No. 2015-193940

[Patent Literature 4] Japanese Patent No. 4384959

SUMMARY OF INVENTION

Technical Problem

In all of Patent Literatures 1 to 4 described above, water-repellent knitted fabrics are described, but a knitted fabric having sufficient water repellency, Water drainage, and Bursting Strength is not mentioned therein.

The Water drainage tends to be improved by increasing the size or the number of voids. In this case, however, durability (laundering durability, durability in use, and the like) tends to deteriorate. Therefore, an object of the present invention is to provide a water-repellent knitted fabric excellent in laundering resistance (laundering durability) and having sufficient water repellency, Water drainage and Bursting Strength, and a method for producing the water-repellent knitted fabric.

Another object of the present invention is to provide clothing made of a water-repellent knitted fabric excellent in laundering resistance (laundering durability) and having sufficient water repellency, Water drainage and Bursting Strength, and layering including the clothing.

Solution to Problem

A water-repellent knitted fabric of the present invention is a knitted fabric which comprises a multifilament made of a thermoplastic resin and has a water repellent imparted to a surface of the knitted fabric. The water repellent may be imparted to a surface of the multifilament.

The water-repellent knitted fabric satisfies the following conditions (1) to (4):

(1) the number of voids between stitches of the knitted fabric is 20 to 40/[12 cm×12 cm], and the voids have a size of 7 $mm^2$ to 25 $mm^2$;

(2) initial water repellency is at a grade 3 or higher, and preferably at a grade 4 or higher;

(3) initial Water drainage is 70% or more; and (4) initial Bursting Strength is 200 kPa or more and 500 kPa or less.

<Voids>

The number of voids (holes) is 20 to 40/[12 cm×12 cm], and the voids have a size of 7 $mm^2$ to 25 $mm^2$, and preferably, the number of voids is 28 to 35/[12 cm×12 cm], and the voids have a size of 7.5 $mm^2$ to 23 $mm^2$. In the present invention, when the number and the size of the voids simultaneously fall in the specific ranges, excellent balance can be obtained therebetween, and the knitted fabric can be good at both Water drainage and Bursting Strength. For example, if the size of voids is simply increased or the number of voids is simply increased for improving the Water drainage, the Bursting Strength is deteriorated. In reverse, if the size of voids is reduced or the number of voids is reduced for improving the Bursting Strength, the Water drainage becomes poor.

In the present invention, a void is not limited to a mesh pore of a mesh structure, but is a concept including voids (pores) formed in another knitted structure.

The voids are in the shape of, for example, a circle, an oval, or an ellipse.

<Water Repellency Test>

The water repellency is measured in accordance with a spray method described in JIS L-1092.

<Evaluation of Water drainage>

As for the Water drainage, the Water drainage obtained at an initial stage or after 100 times of home laundering is 70% or more, preferably 73% or more, more preferably 75% or more, and further preferably 80% or more.

The Water drainage is measured as follows:

On an acrylic plate of a 20 cm square, 0.6 ml of water is dropped, and a water-repellent knitted fabric is overlayed thereon. A knitted fabric (a fabric of "Drought Force" manufactured by finetrack Co., Ltd., polyester 100%, weight: 120 g/m$^2$) cut into a 20 cm square is overlayed on the water-repellent knitted fabric, and a load of 300 g in total (300 g/400 cm$^2$) including an acrylic plate of a 20 cm square and an appropriate weight is applied thereto. One minute after, a mass of the knitted fabric (the fabric of Drought Force having absorbed water) is measured to calculate the Water drainage in accordance with the following expression. It is noted that a unit of the mass is gram.

Water drainage (%)=100×(mass of Drought Force having absorbed water−initial mass of Drought Force)/initial amount of water(0.6 ml)

In the present invention, an "initial" state of a knitted fabric refers to a state immediately after production of the knitted fabric, or a state where the knitted fabric is distributed as a product available for a consumer in a retail store or the like. The same applies to description given below.

In the present invention, "home laundering" is performed in accordance with a method 103 described in JIS L-0217. The same applies to the description given below.

<Evaluation of Bursting Strength>

The Bursting Strength is measured in accordance with a method A of JIS L-1096.

As for the Bursting Strength, the Bursting Strength obtained at an initial stage or after 100 times of home laundering is 200 kPa or more and 500 kPa or less, preferably 230 kPa or more and 500 kPa or less, and more preferably 250 kPa or more and 480 kPa or less.

The multifilament includes one or more single fibers. Each single fiber may have a circular or modified cross-section taken in a vertical direction to a lengthwise direction of the fiber.

The circular cross-section can be in the shape of, for example, a circle, an ellipse, a rounded rectangle, continuous three balls, continuous four balls, or the like (see FIG. 1A). The cross-sectional shape may be constant or varied along the lengthwise direction of the fiber.

The single fiber preferably has a modified cross-sectional shape, and among modified cross-sectional shapes, one including two or more different cross-sectional shapes, and each cross-sectional shape includes one or more projections in an outer periphery in a cross-section taken in the vertical direction to the lengthwise direction of the single fiber is preferred (see FIG. 1B). That is, the multifilament may include a plurality of single fibers having different cross-sectional shapes each other. The single fiber may have one or more projections in an outer periphery in a cross-section taken in the vertical direction to the lengthwise direction of the single fiber.

As for the cross-section having one or more projections in the outer periphery, the cross-sectional shape taken in the vertical direction to the lengthwise direction of the single fiber included in the multifilament can be, for example, a polygonal shape such as a triangle, a multi-leaf shape, a star shape, or a cross shape. The single fiber included in the multifilament preferably includes one, or a combination or two or more selected from these (see FIGS. 1C and 1D).

The multifilament includes, for example, a combined filament yarn combined with another fiber, a twisted yarn twisted with another fiber, or a false-twisted yarn.

From the viewpoint of obtaining excellent texture (bounce, swell, and tension), the water-repellent knitted fabric may further satisfy the following condition (5):

(5) an initial flexural rigidity B value is 0.0250 gf·cm$^2$/cm or less, and a 2HB value is 0.0110 gf·cm/cm or less.

From the viewpoint of obtaining excellent laundering durability of the texture, the water-repellent knitted fabric preferably has, after 120 times of home laundering, a flexural rigidity value B of 0.0150 gf·cm$^2$/cm or less, and a 2HB value of 0.0200 gf·cm/cm or less.

Besides, a rate of change between the initial flexural rigidity value B and the flexural rigidity value B obtained after 120 times of home laundering is preferably −75% or more, and more preferably −72% or more. Furthermore, a rate of change between the initial 2HB value and the 2HB value obtained after 120 times of home laundering is preferably 75% or less.

The flexural rigidity (B and 2HB values) is measured in accordance with a KES method. The same applies to the description given below.

Rate of change[%]=(value obtained after120times of home laundering−initial value)/initial value×100

From the viewpoint of obtaining excellent laundering durability of water repellency, the water-repellent knitted fabric may further satisfy the following condition (6):

(6) the water repellency measured in accordance with the spray method after 100 times of home laundering is at a grade 3 or higher.

In the water-repellent knitted fabric, the water repellency obtained after 120 times of home laundering is at the grade 3 or higher, and more preferably, the water repellency obtained after 150 times of home laundering is at the grade 3 or higher.

In the water-repellent knitted fabric, the water repellent is not especially limited as long as water repellency can be exhibited, and in consideration of environmental influences, the water repellent may be one, two or more selected from a fluorine-based water repellent having a perfluoroalkyl group having 6 or less carbon atoms, a silicone-based water repellent, and a hydrocarbon-based water repellent.

Preferably, the water repellent is caused to adhere homogeneously or substantially homogeneously onto a first main surface, a second main surface, and/or an inside portion in the thickness direction of the knitted fabric.

An amount of the water repellent adhered is, for example, 1.1 g/m$^2$ to 6.0 g/m$^2$, preferably 1.2 g/m$^2$ to 5.0 g/m$^2$, and more preferably 1.3 g/m$^2$ to 4.5 g/m$^2$. When the amount of the water repellent adhered is less than 1.1 g/m$^2$, the laundering durability may be deteriorated in some cases, and when it exceeds 6.0 g/m$^2$, the texture may be deteriorated in some cases.

Examples of a knitted structure of the water-repellent knitted fabric include waffle, plain, smooth, circular rib, lace, mesh, blister, reversible structure, tricot, raschel, jacquard, a single knitted fabric, a double knitted fabric, a round knitted fabric, a flat knitted fabric, and a warp knitted fabric. Among these, a mesh structure is preferred from the viewpoint of excellent balance among the water repellency, the Water drainage, the Bursting Strength, and the texture.

From the viewpoint of obtaining excellent texture on the surface, the water-repellent knitted fabric may further satisfy the following conditions (A) and (B):

(A) an average friction coefficient (MIU) is 0.220 or less and a friction coefficient variation (MMD) is 0.0250 or less in initial surface characteristics, and after 120 times of home laundering, the average friction coefficient (MIU) is 0.230 or less, and the friction coefficient variation (MMD) is 0.0270 or less; and (B) a rate of change between the initial average friction coefficient (MIU) and the average friction coefficient obtained after 120 times of home laundering is 6.0% or less, and a rate of change between the initial friction coefficient variation (MMD) and the friction coefficient variation (MMD) obtained after 120 times of home laundering is 12.0% or less.

The average friction coefficient (MIU) and the friction coefficient variation (MMD) of the surface characteristic are measured in accordance with the KES method. The same applies to the description given below.

<Evaluation of Bending Characteristic Values>

A bending characteristic value is an index for evaluating the "bounce", "swell", and "tension" of the texture.

A bending characteristic value is measured using a bending characteristic measuring apparatus (Pure Bending Tester "KES-FB2", manufactured by Kato Tech Co., Ltd.).

A bending characteristic value is measured by using a sample (20 cm×1 cm) at a maximum curvature±2.5 $cm^{-1}$.

A flexural rigidity value B of the bending characteristic refers to flexural rigidity per cm of the width of a fabric, and assuming that a bending moment per cm of the width is M (gf·cm/cm) and a curvature is K ($cm^{-1}$), K is represented by average inclination dM/dK (gf·$cm^2$/cm) between 0.5 $cm^{-1}$ and 1.5 $cm^{-1}$.

A hysteresis width, a 2HB value, of the bending characteristic refers to bending hysteresis (gf·cm/cm) per cm of the width of a fabric.

A flexural rigidity value B is used for evaluating softness and rigidity felt when a human bends an object, and as the value B is larger, the object is more rigid, and as the value is smaller, the object is softer.

The bending hysteresis width (2HB value) is used for evaluating restorability (elasticity) felt when a human bends an object and restores it, and as the 2HB value is larger, the restorability is poorer, and as the value is smaller, the restorability is better.

<Evaluation of Average Friction Coefficient (MIU) and Friction Coefficient Variation (MMD)>

An average friction coefficient (MIU) is an index for evaluating "non-slipperiness" felt when touched with a hand. Besides, friction coefficient variation (MMD) is an index for evaluating "roughness" felt when touched with a hand.

The average friction coefficient (MIU) and the friction coefficient variation (MMD) are measured using a friction tester (surface tester "KES-FB4", manufactured by Kato Tech Co., Ltd.).

<Sensory Evaluation of Texture>

From the viewpoint of obtaining excellent surface texture, the water-repellent knitted fabric may further satisfy the following condition (C):

(C) a sample of the knitted fabric cut into a 20 cm square is placed on the inside of the forearm, and rubbed against the skin with the sample lightly held with the palm of the other arm.

"Soft and gentle feel (gentle texture)" and "feel that is not rough but smooth and difficult to cling to the skin (smooth texture)" felt in this operation are subjected to sensory evaluation. Ten panelists (females in their 20s to 40s) perform the sensory evaluation by touching to obtain an average of scores of the ten panelists rated based on the following criteria: Good texture: 4; average: 2; poor: 0. In the evaluation of either item, an average score of 3.0 or more can be determined as good texture.

<Weight of Knitted Fabric>

A weight of the water-repellent knitted fabric is, for example, 40 g/$m^2$ to 200 g/$m^2$, and preferably 45 g/$m^2$ to 110 g/$m^2$.

<Thickness of Knitted Fabric>

A thickness of the water-repellent knitted fabric is, for example, 200 μm to 1500 μm, and preferably 300 μm to 1000 μm. The thickness of the water-repellent knitted fabric is measured in accordance with the method A described in JIS L1096, 8.4 Thickness.

<Production Method>

A method for producing a water-repellent knitted fabric of the present invention comprises subjecting a knitted fabric comprising a multifilament made of a thermoplastic resin, having the number of voids of 20 to 40/[12 cm×12 cm] between stitches, and having a size of the voids of 7 $mm^2$ to 25 $mm^2$ to water absorption processing with a water absorbent, followed by water repellent processing with a water repellent.

When this production method is employed, a water-repellent knitted fabric that has excellent and sufficient water repellency, Water drainage, and Bursting Strength owing to laundering resistance (laundering durability) can be satisfactorily produced.

In the production method, the water absorption processing may be performed before or after dyeing processing. In this case, another step may be performed between the dyeing processing and the water absorption processing.

In the production method, the water absorption processing may be performed simultaneously with the dyeing processing. For example, the water absorbent may be added to a dyebath to perform the dyeing processing and the water absorption processing simultaneously.

In the production method, the water absorption processing, the water repellent processing, and post-processing (final set) may be performed in the stated order.

In the production method, the dyeing processing, the water absorption processing, the water repellent processing, and the post-processing (final set) may be performed in the stated order.

In the production method, the simultaneous dyeing and water absorption processing, the water repellent processing, and the post-processing (final set) may be performed in the stated order.

In the production method, a scouring treatment may be performed before the dyeing processing and the water absorption processing.

In the production method, an alkali weight reduction treatment may be performed before the dyeing processing.

In the production method of the present invention, it is preferable to perform the water absorption processing with a water absorbent and the water repellent processing with a water repellent. The water absorption processing and the water repellent processing are processing for attaining conflicting properties. In the present invention, however, a moisture (water molecules) contained in the knitted fabric is suitably absorbed by the water absorbent in the water absorption processing, and as a result, a large amount of the water repellent can be caused to adhere to the knitted fabric, without being disturbed by the moisture, in the water repellent processing subsequently performed, and thus, a water-repellent knitted fabric having high durability can be suitably produced. In other words, since the water absorption processing with a water absorbent is performed priorly, the water repellent is better spread, and hence, adhesiveness, adhesion strength, an amount of the water repellent adhered and an adhesion area of the water repellent can be further increased.

Besides, since the adhesion strength of the water repellent is further improved than usual, there is no need to increase the amount of a water repellent having low adhesion strength adhered. Since there is no need to increase the amount of the water repellent adhered, deterioration (degradation) of texture otherwise caused in proportion to the amount of the water repellent adhered can be further suppressed.

Another method for producing a water-repellent knitted fabric comprises subjecting a multifilament made of a thermoplastic resin to water absorption processing with a water absorbent, followed by water repellent processing with a water repellent and knitting processing.

When this production method is employed, a water-repellent knitted fabric that has excellent and sufficient water repellency, Water drainage, and Bursting Strength owing to laundering resistance (laundering durability) can be satisfactorily produced.

In the production method, the water absorption processing may be performed before or after dyeing processing. In this case, another step may be performed between the dyeing processing and the water absorption processing.

In the production method, the water absorption processing may be performed simultaneously with the dyeing processing. For example, the water absorbent may be added to a dyebath to perform the dyeing processing and the water absorption processing simultaneously.

In the production method, post-processing (final set) may be performed before the knitting processing.

In the production method, the water absorption processing, the water repellent processing, the post-processing (final set), and the knitting processing may be performed in the stated order.

In the production method, the dyeing processing, the water absorption processing, the water repellent processing, the post-processing (final set), and the knitting processing may be performed in the stated order.

In the production method, the simultaneous dyeing and water absorption processing, the water repellent processing, the post-processing (final set), and the knitting processing may be performed in the stated order.

In the production method, a scouring treatment may be performed before the dyeing processing and the water absorption processing.

In the production method, an alkali weight reduction treatment may be performed before the dyeing processing.

<Clothing and Layering>

Clothing of the present invention is clothing to be in direct contact with the skin, and is made of the water-repellent knitted fabric described above.

Besides, the clothing of the present invention is clothing to be in direct contact with the skin, and is made of a water-repellent knitted fabric produced by the method for producing a water-repellent knitted fabric described above.

Examples of the clothing (undergarment) include shirts, underpants, trousers, socks, an inner of a hat, gloves, an underwear, a brassiere, panties, a T shirt, tights, and a balaclava.

Layering of the present invention includes at least the clothing, and at least one (first) upper clothing to be directly layered on the clothing.

The layering may further include second upper clothing to be further layered on the first upper clothing.

The layering may further include third upper clothing to be further layered on the second upper clothing.

In the layering, another clothing may be further layered on the third upper clothing.

The clothing of the present invention causes sweat generated from the skin to rapidly permeate. Owing to the highly durable water repellency, re-wetness with sweat or rain can be prevented.

The first upper clothing is made of a fabric having, for example, at least a sweat absorbing/diffusing property, and further having one or more functions out of heat retention, moisture control, and the like. An outerwear (having at least a waterproof breathable property) may be worn on the first upper clothing.

The second upper clothing is made of a fabric having, for example, at least a sweat absorbing/diffusing property or a sweat absorbing/transpiring property, and further having one or more functions out of heat retention, moisture control, and the like. An outerwear (having at least a waterproof breathable property) may be worn on the second upper clothing.

The third upper clothing is made of a fabric having, for example, at least a breathable property, and further having one or more functions out of water resistance, heat retention, windproofness, dew condensation prevention, and waterproofness. An outerwear (having at least a waterproof breathable property) may be worn on the third upper clothing.

The clothing (undergarment) made of the water-repellent knitted fabric of the present invention is excellent in laundering durability, has a water-repellent function good in friction durability when layered, and is excellent in texture.

BRIEF DESCRIPTION OF DRAWINGS

FIG. 3A is a diagram illustrating steps of examples and comparative examples.

FIG. 3B is a diagram illustrating evaluation results of the examples and the comparative examples.

FIG. 3C is a diagram illustrating evaluation results of the examples and the comparative examples.

FIG. 3D is a diagram illustrating evaluation results of the examples and the comparative examples.

FIG. 3E is a diagram illustrating evaluation results of the examples and the comparative examples.

DESCRIPTION OF EMBODIMENTS

Embodiment 1

Now, a preferred embodiment of the present invention will be described with reference to the accompanying drawings, and it is noted that the present invention is not limited to the embodiment.

FIGS. 1A, 1B, 1C and 1D illustrate examples of a cross-sectional shape of a single fiber included in a multifilament.

The cross-sectional shape of the single fiber included in the multifilament is not especially limited, and any of those illustrated in FIGS. 1A, 1B, 1C and 1D can be employed.

Figure 1A:
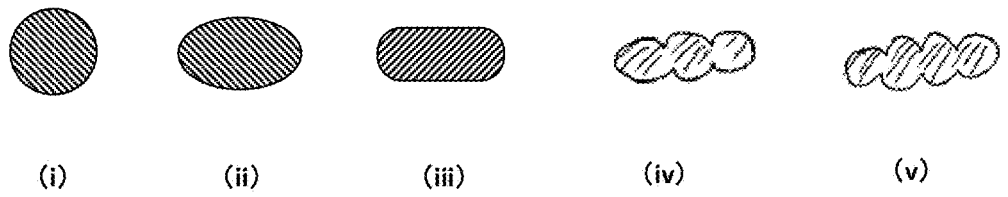
FIG. 1A is a diagram illustrating examples of a cross-sectional shape of a single fiber included in a multifilament.

FIG. 1A illustrates an example of a circular cross-section. FIG. 1A(i) illustrates a circular cross-section, FIG. 1A(ii) illustrates an elliptical cross-section, FIG. 1A(iii) illustrates a rounded rectangular cross-section, FIG. 1A(iv) illustrates a cross-section in the shape of continuous three balls, and FIG. 1A(v) illustrates a cross-section in the shape of continuous four balls.

The single fiber included in the multifilament preferably has two or more different cross-sectional shapes, and has one or more projections in an outer periphery in a cross-section taken in the vertical direction to the lengthwise direction of the single fiber. When a synthetic fiber having two or more different cross-sectional shapes, and having one or more projections in the outer periphery is used, fine gaps can be formed between fibers, and thus further excellent Water drainage is attained.

Figure 1B:
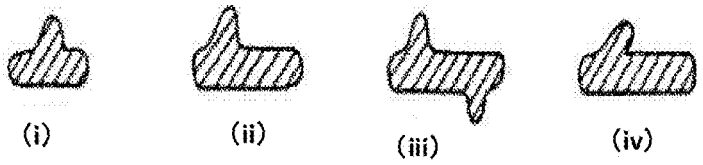
FIG. 1B is a diagram illustrating other examples of the cross-sectional shape of the single fiber included in the multifilament.
Figure 1C:
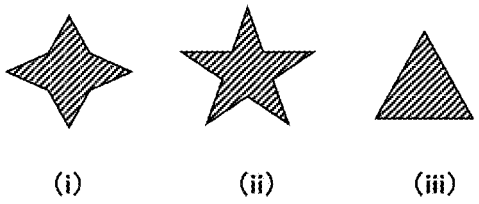
FIG. 1C is a diagram illustrating other examples of the cross-sectional shape of the single fiber included in the multifilament.
Figure 1D:
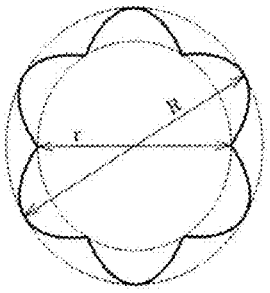
FIG. 1D is a diagram illustrating still other examples of the cross-sectional shape of the single fiber included in the multifilament.

FIGS. 1B, 1C and 1D illustrate examples of a modified cross-sectional shape having one or more projections in the outer periphery.

FIGS. 1B(i), 1B(ii) and 1B(iv) illustrate examples having one projection in the outer periphery. FIGS. 1C(i), 1C(ii) and 1C(iii) respectively illustrate, as examples having one or more projections in the outer periphery, a cross-shaped cross-section, a star-shaped cross-section, and a triangle-shaped cross-section. FIG. 1B(iii) illustrates an example having two projections in the outer periphery.

FIG. 1D illustrates, as one of multi-leaf cross-sectional shapes, a six-leaf cross-sectional shape in which six projections (leaves) are substantially uniformly repeatedly disposed. In the drawing, R denotes a maximum distance between two opposing projections, and r denotes a diameter of a circular cross-section. In the multi-leaf cross-sectional shape, the number of projections (leaves) is not limited to six, but may be fewer or more (for example, twenty).

The cross-sectional shape having one or more projections in the outer periphery may include a shape having an oblateness of 1.1 to 5. This oblateness is a value obtained as follows: Oblatenesses are obtained, in accordance with the following expression, for all constituent filaments of a fiber to be measured, and an average of the oblatenesses is calculated.

Oblateness=(length in the long axis direction of the cross-section of the fiber)/(length in the short axis direction of the cross-section of the fiber)

In the present invention, when the multifilament is constructed by employing a modified cross-section, or by combining two or more single fibers respectively having different cross-sectional shapes, fine gaps can be formed between fibers, and thus further excellent Water drainage is obtained.

A water-repellent knitted fabric of the present embodiment is a knitted fabric which comprises a multifilament made of a thermoplastic resin and has a water repellent imparted to the knitted fabric or the multifilament.

<Water Repellent>

The water repellent may be one or more selected from a fluorine-based water repellent having a perfluoroalkyl group having 6 or less carbon atoms, a silicone-based water repellent, and a hydrocarbon-based water repellent.

It is preferable that the water repellent is caused to adhere homogeneously or substantially homogeneously onto a first main surface, a second main surface, and an inside portion in the thickness direction of the knitted fabric.

An amount of the water repellent adhered is, for example, 1.1 g/m$^2$ to 6.0 g/m$^2$, preferably 1.2 g/m$^2$ to 5.0 g/m$^2$, and more preferably 1.3 g/m$^2$ to 4.5 g/m$^2$. When the amount of the water repellent adhered is less than 1.1 g/m$^2$, the laundering durability may be deteriorated in some cases, and when it exceeds 6.0 g/m$^2$, the texture may be deteriorated in some cases.

The amount of the water repellent adhered is obtained in accordance with the following expression:

Amount of water repellent adhered(g/m$^2$)=weight (g/m$^2$)×wet-pick-up rate (%)×concentration (%) of water repellent×solid content concentration (%) in water repellent A wet-pick-up rate refers to a rate of a mass of a water-repellent processing liquid adhering to the knitted fabric to a mass of a knitted fabric before the immersion obtained after immersing the knitted fabric not subjected to water-repellent processing in the water-repellent processing liquid and squeezing the resultant knitted fabric, and is calculated in accordance with the following expression. It is noted that the masses are in the unit of gram.

Wet-pick-up rate (%)={(mass of fabric after immersion and squeeze−initial mass of fabric)/initial mass of fabric}×100

The water-repellent knitted fabric of the present embodiment needs to satisfy the conditions (1) to (4) described below, and preferably further satisfies one or more of the other conditions (5) to (10).

(1) The number of voids between stitches of the knitted fabric is 20 to 40/[12 cm×12 cm], and the voids have a size of 7 mm$^2$ to 25 mm$^2$, and preferably the number of voids is 28 to 35/[12 cm×12 cm] and the size of the voids is 7.5 mm$^2$ to 23 mm$^2$.

(2) Initial water repellency is at a grade 3 or higher, and preferably at a grade 4 or higher.

(3) Initial Water drainage or Water drainage obtained after 100 times of home laundering is 70% or more, and preferably 73% or more, more preferably 75% or more, and further preferably 80% or more.

(4) Initial Bursting Strength or Bursting Strength obtained after 100 times of home laundering is 200 kPa or more and 500 kPa or less, preferably 250 kPa or more and 500 kPa or less, and more preferably 280 kPa or more and 480 kPa or less.

(5) An initial flexural rigidity B value is 0.0250 gf·cm$^2$/cm or less, and a 2HB value is 0.0110 gf·cm/cm or less. Preferably, the flexural rigidity B value and the 2HB value obtained after 120 times of home laundering are respectively 0.0150 gf·cm$^2$/cm or less and 0.0200 gf·cm/cm or less.

(6) Water repellency measured after performing home laundering 100 times is at the grade 3 or higher, it is preferable that the water repellency measured after performing home laundering 120 times is at the grade 3 or higher, and it is more preferable that the water repellency measured after performing home laundering 150 times is at the grade 3 or higher.

(7) A rate of change between the initial flexural rigidity value B and the flexural rigidity value B measured after performing home laundering 120 times is −75% or more, and preferably −72% or more, and a rate of change between the initial 2HB value and the 2HB value measured after performing home laundering 120 times is 75% or less.

(8) The average friction coefficient (MIU) is 0.220 or less and friction coefficient variation (MMD) is 0.0250 or less in initial surface characteristics, and the average friction coefficient (MIU) is 0.230 or less and the friction coefficient variation (MMD) is 0.0270 or less after performing home laundering 120 times.

(9) A rate of change between the initial average friction coefficient (MIU) and the average friction coefficient (MIU)

measured after performing home laundering 120 times is 6.0% or less, and a rate of change between the initial friction coefficient variation (MMD) and the friction coefficient variation (MMD) measured after performing home laundering 120 times is 12.0% or less.

(10) A sample of the knitted fabric cut into a 20 cm square is placed on the inside of the forearm, and rubbed against the skin with the sample lightly held with the palm of the other arm. "Soft and gentle feel (gentle texture)" and "feel that is not rough but smooth and difficult to cling to the skin (smooth texture)" felt in this operation are subjected to sensory evaluation. Ten panelists (females in their 20s to 40s) perform the sensory evaluation by touching, and the average of scores among the ten panelists rated based on the following criteria was obtained: Good texture: 4; average: 2; and poor: 0. In the evaluation of either item, an average score of 3.0 or more can be determined as good texture.

The respective measurement methods have been already described.

When the initial flexural rigidity value B exceeds 0.0250 gf·cm$^2$/cm, the knitted fabric is hard, and hence the texture (bounce, swell, and tension) felt when worn may become poor in some cases. Although the flexural rigidity value B is reduced through home laundering, the rate of change is preferably retained at −70% or more in the present embodiment, and thus, extreme reduction of the texture otherwise caused by home laundering can be suppressed.

When the initial bending hysteresis width (2HB value) exceeds 0.0110 gf·cm/cm, restorability is degraded, and hence the texture (bounce, swell, and tension) felt when worn may become poor in some cases. Although the 2HB value is increased through home laundering, the rate of change is preferably retained at 75% or less in the present embodiment, and thus, extreme reduction of the texture otherwise caused by home laundering can be suppressed.

When the initial average friction coefficient (MIU) is 0.220 or less, the knitted fabric is evaluated to be low in "non-slipperiness" (namely, to be slippery). Although the average friction coefficient (MIU) is increased (namely, the knitted fabric becomes less slippery) through home laundering, the rate of change is preferably retained at 6.0% or less in the present embodiment, and thus, extreme reduction of the texture otherwise caused by home laundering can be suppressed.

When the friction coefficient variation (MMD) is 0.0250 or less, the knitted fabric is evaluated to be low in "roughness", namely, to be smooth. Although the friction coefficient variation (MMD) is increased (namely, roughness is increased) through home laundering, the rate of change is preferably retained at 12.0% or less in the present embodiment, and thus, extreme reduction of the texture otherwise caused by home laundering can be suppressed.

<Knitted Structure>

Examples of a knitted structure of the water-repellent knitted fabric include waffle, plain, smooth, circular rib, lace, mesh, blister, reversible structure, tricot, raschel, jacquard, a single knitted fabric, a double knitted fabric, a round knitted fabric, a flat knitted fabric, and a warp knitted fabric. Among these, a mesh structure is preferred from the viewpoint of excellent balance among the water repellency, the Water drainage, the Bursting Strength, and the texture.

<Knitting Density>

A knitting density of the water-repellent knitted fabric is, for example, in terms of the number of courses (C) in one inch, 20 to 60, and preferably 30 to 40, and in terms of the number of wales (W) in one inch, 15 to 50, and preferably 20 to 30. A combination of courses/inch (C) and wales/inch (W) is preferably a combination of the above-described ranges, and is preferably, for example, 32 (C)/23 (W), 32 (C)/25 (W), 35 (C)/25 (W), or the like.

<Weight of Knitted Fabric>

A weight of the water-repellent knitted fabric is, for example, 40 g/m$^2$ to 200 g/m$^2$, and preferably 45 g/m$^2$ to 110 g/m$^2$.

<Thickness of Knitted Fabric>

A thickness of the water-repellent knitted fabric is, for example, 200 μm to 1500 μm, and preferably 300 μm to 1000 μm. The thickness of the water-repellent knitted fabric is measured in accordance with a method A described in JIS L1096, 8.4 Thickness.

<Multifilament>

The multifilament made of a thermoplastic resin can be one made of, for example, a polyester-based fiber, a polyamide-based fiber or a polyolefin-based fiber.

Examples of a polyester resin composing the polyester-based fiber include aromatic polyesters such as polyethylene terephthalate, polybutylene terephthalate, and polytrimethylene terephthalate, cation-dyeable polyesters, and polylactic acids. The polyester-based fiber is preferred because of wrinkle resistance and excellent strength.

Examples of a polyamide resin composing the polyamide-based fiber include nylon 6, nylon 66, nylon 46, nylon 11, and nylon 56. The polyamide-based fiber is excellent in strength and further in water absorption, and hence can be expected to improve the Water drainage.

Examples of a polyolefin resin composing the polyolefin-based fiber include polypropylene, and polyethylene.

The multifilament made of a thermoplastic resin has a single-fiber fineness of, for example, 0.1 dtex to 10 dtex, preferably 0.3 dtex to 8 dtex, and more preferably 0.5 dtex to 6 dtex.

The multifilament made of a thermoplastic resin has a total fineness of, for example, 30 dtex to 300 dtex, preferably 30 dtex to 250 dtex, and more preferably 30 dtex to 180 dtex.

The number of filaments of the multifilament made of a thermoplastic resin is determined in accordance with the single-fiber fineness and the total fineness of a single fiber to be used, and is, for example, 2 to 400.

The multifilament includes, for example, a combined filament yarn combined with another fiber, a twisted yarn twisted with another fiber, or a false-twisted yarn.

Another fiber can be, for example, a synthetic fiber such as acrylic and polyurethane, a recycled fiber such as rayon, a semi-synthetic fiber such as acetate, and a natural fiber such as cotton and wool.

<Production Method>

Figure 2A:
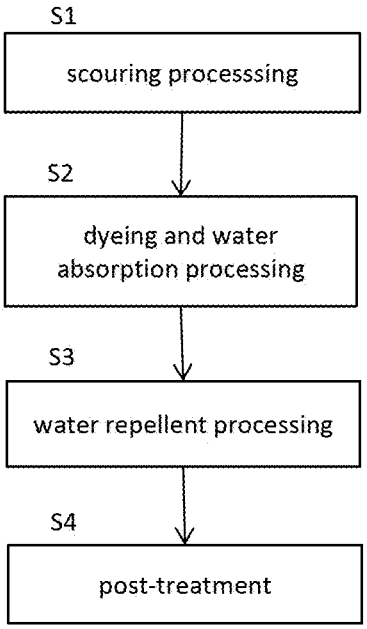
FIG. 2A is a flowchart illustrating an example of a production method.

A first method for producing a water-repellent knitted fabric comprises the steps of subjecting a knitted fabric comprising a multifilament made of a thermoplastic resin, having a number of voids of 20 to 40/[12 cm×12 cm] between stitches, and having a size of the voids of 7 mm$^2$ to 25 mm$^2$ to scouring processing, dyeing and water absorption processing (including drying), water repellent processing, and a post-treatment. In this production method, the dyeing processing may be performed simultaneously with the water absorption processing (see FIG. 2A). The post-treatment is omitted in some cases.

Figure 2B:
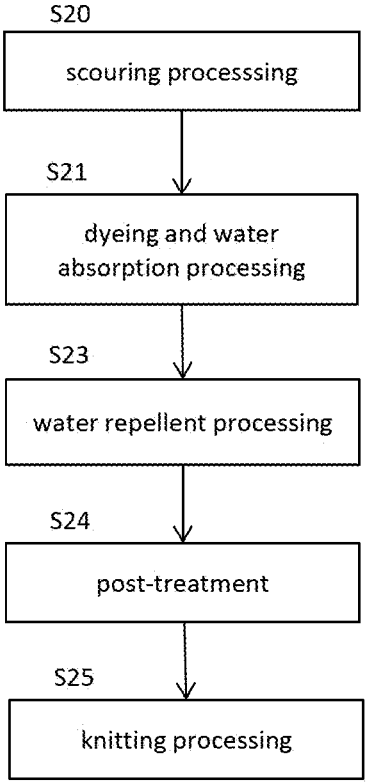
FIG. 2B is a flowchart illustrating another example of the production method.

A second method for producing a water-repellent knitted fabric comprises the steps of subjecting a multifilament to scouring processing, dyeing and water absorption processing (including drying), water repellent processing, and a post-treatment, followed by a step of knitting processing (see FIG. 2B). The post-treatment is omitted in some cases.

Since the water repellent processing is performed in the form of a yarn, an effect to cause a water repellent to adhere to the fiber is further improved as compared with a case where it is performed in the form of a knitted fabric. Besides, the method can be employed for producing a product, such as socks, gloves, or an undergarment, employing a production method of directly knitting from a yarn.

The first method or the second method can be selected in accordance with the type and the fineness of a single fiber, the cross-sectional shape of the single fiber, the type of a knitted structure, and the like.

The water repellent processing of a multifilament is a step of causing a water repellent to adhere to the multifilament having been subjected to the water absorption processing. The water repellent processing is performed, for example, by a method in which the multifilament is continuously reeled out and conveyed from a bobbin (or a cone) where the multifilament is wound and is immersed in a water repellent bath or the like for a prescribed period of time for causing a water repellent to adhere thereon (bath conveyance), or by a method in which a hank of or a bobbin of the multifilament is immersed in a water repellent bath or the like for a prescribed period of time for causing a water repellent to adhere thereon. The water repellent processing may include a prescribed dehydrating or drying treatment.

The water repellent to be used in the water repellent processing of the multifilament is not especially limited as long as water repellency can be exhibited, and in consideration of environmental influences, the water repellant may be one or more selected from a fluorine-based water repellent having a perfluoroalkyl group having 6 or less carbon atoms, a silicone-based water repellent, and a hydrocarbon-based water repellent. It is noted that an auxiliary agent such as a crosslinking agent, a softener, an antistatic agent, or a catalyst may be used in addition to the water repellent.

An amount of the water repellent adhered on the multifilament is, for example, 1.1 $g/m^2$ to 6.0 $g/m^2$, preferably 1.2 $g/m^2$ to 5.0 $g/m^2$, and more preferably 1.3 $g/m^2$ to 4.5 $g/m^2$. When the amount of the water repellent adhered is less than 1.1 $g/m^2$, the laundering durability may be deteriorated in some cases, and when it exceeds 6.0 $g/m^2$, the texture may be deteriorated in some cases.

When the water repellent processing is performed in the latter step, the amount adhered may be smaller than that described above, so as to make adjustment for ultimately attaining the above-described amount adhered.

The knitting processing is a step of knitting the multifilament into a prescribed knitted structure. Through this step, a knitted fabric comprising the multifilament made of a thermoplastic resin, having a number of voids of 20 to 40/[12 cm×12 cm] between stitches, and having a size of the voids of 7 $mm^2$ to 25 $mm^2$ is obtained. A knitting machine to be used for the knitting processing is, for example, a circular knitting machine, a weft knitting machine, or a warp knitting machine.

The scouring processing is a step of removing, from the knitted fabric or the multifilament, impurities such as dirt, an oil, or a starch by using, for example, a bleach, a detergent or the like. It is noted that an auxiliary agent such as a chelating agent or a penetrating agent may be used.

In the production method, alkali weight reduction processing may be performed before the dyeing/water absorption processing. The alkali weight reduction processing is a step of reducing the weight by dissolving (hydrolyzing) a surface of the knitted fabric or the multifilament with a strong alkaline solution such as caustic soda. The extent of the weight reduction is preferably determined in consideration of both the texture and the laundering durability of the water repellent. It is noted that an auxiliary agent such as a weight reduction processing accelerator may be used.

The dyeing processing is a step of dyeing the knitted fabric or the multifilament with a dye. In addition to the dye, a chelating agent, a penetration leveling agent, a disperse leveling agent, an auxiliary agent, a penetrating agent or the like may be used. Examples of a dyeing method include a method in which the knitted fabric or the multifilament having a large length is immersed for dyeing in a dyebath or the like for a prescribed period of time during continuous conveyance (such as a one-bath dyeing method, a one-bath multistage dyeing method, or a multiple bath multistage dyeing method), and a batch dyeing method such as a thermosol dyeing method, a cold pad batch method, a high pressure jet dyeing method, a high pressure beam dyeing method, a pad steam method, a pad dyeing method, or a rapid dyeing method. After performing the dyeing for a prescribed period of time, the knitted fabric or the multifilament is washed, dehydrated, and dried.

In the present production method, when the dyeing and the water absorption are simultaneously performed, a bath liquid of the dyebath may contain at least a dye and a water absorbent.

Soaping may be performed after the dyeing processing, or soaping may be performed after the water repellent processing.

The water absorbent (also designated as a water absorption processing agent) is an additive for imparting hydrophilicity to a fiber and improving affinity with water. The type of the water absorbent used in the present invention is not especially limited, and examples include polyethylene glycol, a polyethylene oxide-based compound such as a polyethylene oxide-addition polyester-based compound (such as a block copolymer of polyethylene glycol and polyethylene terephthalate), a polyethylene oxide-addition fluorine-based compound, or a polyethylene oxide-addition silicone-based compound, and dialkyl sulfosuccinate such as sodium dioleyl sulfosuccinate. One of these water absorbents may be singly used, or two or more of these may be used in combination. Among these water absorbents, a polyethylene oxide-based compound is preferred, and a polyethylene oxide-addition polyester-based compound is further preferred.

Besides, in addition to the water absorbent, a crosslinking agent, a softener, an antistatic agent, an auxiliary agent, or the like may be used.

As a role of the water absorbent in the present production method, it is used not in expectation of a water absorption function against sweat and the like when worn but in expectation of improvement of adhesion strength of the water repellent through the water repellent processing performed in the latter stage. In comparison between a case where the water repellent processing is performed using an equivalent amount of the water repellent and the present production method (in which the water repellent processing is performed after the water absorption processing) (see Example 1 and Example 9), even when an equivalent amount of the water repellent is adsorbed onto the knitted fabric or the multifilament, adhesion force of the water repellent is higher in the present production method, and therefore, the laundering durability is further increased.

The water repellent processing of the knitted fabric is a step of causing the water repellent to adhere to the knitted fabric having been subjected to the water absorption processing. The water repellent processing may be performed by, for example, a method in which the knitted fabric having a large length is immersed in a water repellent bath or the like for a prescribed period of time during continuous conveyance to cause the water repellent to adhere thereto (bath conveyance), padding, or printing (rolling). The water repellent processing may include a prescribed dehydrating/drying treatment.

The water repellent is not especially limited as long as water repellency can be exhibited, and in consideration of environmental influences, the water repellent may be one or more selected from a fluorine-based water repellent having a perfluoroalkyl group having 6 or less carbon atoms, a silicone-based water repellent, and a hydrocarbon-based water repellent. It is noted that an auxiliary agent such as a crosslinking agent, a softener, an antistatic agent, or a catalyst may be used in addition to the water repellent.

Preferably, the water repellent is homogeneously or substantially homogeneously adhered onto a first main surface, a second main surface, or an inside portion in the thickness direction of the knitted fabric. Besides, the water repellent is preferably adhered homogeneously or substantially homogeneously onto the outer periphery of the multifilament.

"Impartment" and "adhesion" of the water repellent may be attained by a chemical and/or physical mechanism.

An amount of the water repellent adhered is, for example, 1.1 $g/m^2$ to 6.0 $g/m^2$, preferably 1.2 $g/m^2$ to 5.0 $g/m^2$, and more preferably 1.3 $g/m^2$ to 4.5 $g/m^2$.

The post-processing (final set) is finish processing of the knitted fabric or the multifilament, and includes, for example, softening processing, a heat treatment, dimension processing and the like.

Alternative Embodiment

In the production method described above, the water absorption processing may be performed after the dyeing processing instead of simultaneously with the dyeing processing. In this case, the water absorption processing may be performed, for example, by preparing an aqueous solution containing the water absorbent, imparting the aqueous solution to the knitted fabric by a padding method, a spraying method, a kiss roller coater method, a slit coater method or the like, and then performing a dry heat treatment. The aqueous solution may contain, if necessary, a crosslinking agent, a softener, an antistatic agent, an auxiliary agent, or the like.

<Layering>

An underwear is worn directly on the skin. The underwear has water repellency, causes sweat to rapidly permeate, and prevents re-wetness. The underwear is made of the water-repellent knitted fabric having the aforementioned texture, and is made of a water-repellent knitted fabric produced by the above-described method for producing a water-repellent knitted fabric.

Although sweat successively passes through an underwear to an outerwear (moisture permeability), the underwear prevents re-wetness (caused by sweat or rain) (waterproof performance).

A first upper wear is worn on the underwear. The first upper wear has a heat retaining property, a sweat absorbing/diffusing property, and a moisture controlling property, and absorbs sweat coming from the underwear to diffuse it. The first upper wear is made of a fabric of, for example, a chemical fiber of polyester, nylon, acetate, rayon or the like, a natural fiber of wool, silk, cotton or the like, or a blend of any of these.

A second upper wear is worn on the first upper wear. The second upper wear has a heat retaining property, a sweat absorbing/diffusing property, and a transpiring property to evaporate sweat. The second upper wear is made of a fabric of, for example, a chemical fiber of polyester, nylon, acetate, rayon or the like, a natural fiber of wool, silk, cotton or the like, or a blend of any of these.

A third upper wear is worn on the second upper wear. The third upper wear has a windproof property, a heat retaining property, and a waterproof breathable property to cause the evaporated sweat to permeate (pass) to the outside. The third upper wear has, for example, a three-layer structure of nylon or polyester, a fluorine film or a polyurethane film, and nylon or polyester.

An outerwear is worn on the third upper wear. The outerwear has a cold proof property, a wind proof property, a waterproof breathable property, and rain-fastness to cause the evaporated sweat to permeate (pass) to the outside. The outerwear has, for example, a three layer structure of stretchable nylon or polyester, a fluorine film or a polyurethane film, and nylon or polyester.

It is noted that these wears are not limited to those having the aforementioned functions, but the functions may be omitted or another function may be added in accordance with intended use.

<Examples and Comparative Examples of Water-Repellent Knitted Fabric>

FIG. 3A illustrates steps performed in examples and comparative examples, and FIGS. 3B to 3E illustrate evaluation results of the examples and the comparative examples.

The term "HL100" shown in a table indicates 100 times of home laundering.

<Evaluation Methods>

(1) Size of Void (Hole)

A knitted fabric obtained in each of the examples and the comparative examples was enlargedly copied at 400% using a copying machine ("C5240F", manufactured by Canon Inc.), and the size of a void (hole) was obtained based on the thus obtained image.

$$\text{Size of void}(mm^2)=(\text{length of void}/2)\times(\text{width of void}/2)\times 3.14$$

(2) Number of Voids

A knitted fabric obtained in each of the examples and the comparative examples was enlargedly copied at 400% using a copying machine ("C5240F", manufactured by Canon Inc.), and the number of voids included in a 12 cm×12 cm square in the thus obtained image was calculated.

(3) Water Repellency (Laundering Durability)

(3-1) Initial: Initial water repellency was measured in accordance with a spray method described in JIS L-1092.

(3-2) HL100: Water repellency of HL100 was measured in accordance with the spray method described in JIS L-1092 after performing home laundering 100 times in accordance with a method 103 described in JIS L-0217.

(3-3) HL120: Water repellency of HL120 was measured in accordance with the spray method described in JIS L-1092 after performing home laundering 120 times in accordance with the method 103 described in JIS L-0217.

(3-4) HL150: Water repellency of HL150 was measured in accordance with the spray method described in JIS L-1092 after performing home laundering 150 times in accordance with the method 103 described in JIS L-0217.

(4) Texture (4-1) Bending Characteristics

Bending characteristic values were measured using Pure Bending Tester ("KES-FB2", manufactured by Kato Tech Co., Ltd. A bending characteristic value was measured by using a sample (20 cm×1 cm) at a maximum curvature±2.5

$cm^{-1}$. A flexural rigidity value B of a bending characteristic refers to flexural rigidity per cm of the width of a fabric, and assuming that a bending moment per cm of the width is M (gf·cm/cm) and a curvature is K ($cm^{-1}$), K is represented by average inclination dM/dK (gf·$cm^2$/cm) between 0.5 $cm^{-1}$ and 1.5 $cm^{-1}$. A hysteresis width, a 2HB value, of a bending characteristic refers to bending hysteresis (gf·cm/cm) per cm of the width of a fabric.

(4-2) Average Friction Coefficient (MIU) and Friction Coefficient Variation (MMD)

An average friction coefficient (MIU) and friction coefficient variation (MMD) were measured using a surface tester ("KES-FB4", manufactured by Kato Tech Co., Ltd.).

(4-3) Sensory Evaluation of Texture

A sample of each knitted fabric cut into a 20 cm square was placed on the inside of the forearm, and rubbed against the skin with the sample lightly held with the palm of the other arm. "Soft and gentle feel (gentle texture)" and "feel that is not rough but smooth and difficult to cling to the skin (smooth texture)" felt in this operation were subjected to sensory evaluation. Ten panelists (females in their 20s to 40s) performed the sensory evaluation by touching to obtain an average of scores of the ten panelists rated based on the following criteria: Good texture: 4; average: 2; poor: 0. In the evaluation of either item, an average score of 3.0 or more was determined as good texture.

(5) Wet-Pick-Up Rate

A wet-pick-up rate refers to a rate of a mass of a water-repellent processing liquid adhering to a knitted fabric to a mass of a knitted fabric before the immersion, obtained after immersing the knitted fabric not subjected to water-repellent processing in the water-repellent processing liquid and squeezing the resultant knitted fabric, and is calculated in accordance with the following expression. It is noted that the masses are in the unit of gram.

Wet-pick-up rate (%)={(mass of fabric after immersion and squeeze−initial mass of fabric)/initial mass of fabric}×100

(6) Amount of Water Repellent Adhered (g/$m^2$)

Amount of water repellent adhered(g/$m^2$)=weight (g/$m^2$)×wet-pick-up rate (%)×concentration (%) of water repellent×solid content concentration (%) in water repellent (7) Water Drainage On an acrylic plate of a 20 cm square, 0.6 ml of water was dropped, and a water-repellent knitted fabric was overlayed thereon. A knitted fabric (a fabric of "Drought Force" manufactured by finetrack Co., Ltd., polyester 100%, weight: 120 g/$m^2$) cut into a 20 cm square was overlayed on the water-repellent knitted fabric, and a load of 300 g in total (300 g/400 $cm^2$) including an acrylic plate of a 20 cm square and an appropriate weight was applied thereto. One minute after, a mass of the knitted fabric (the fabric of Drought Force having absorbed water) was measured to calculate the Water drainage in accordance with the following expression. It is noted that a unit of the mass was gram.

Water drainage (%)=100×(mass of Drought Force having absorbed water−initial mass of Drought Force)/initial amount of water(0.6 ml)

(8) Bursting Strength

Bursting Strength was measured in accordance with the method A described in JIS L-1096.

Example 1

A false-twisted yarn of Lumiace 73T44 (manufactured by UNITIKA TRADING CO., LTD.; 73 dtex, 44 filaments, the number of projections in the outer periphery of the cross-section of a single fiber: 1, oblateness of the cross-section of the fiber: 1.6) of a polyester-based fiber was used to produce a mesh knitted fabric having the following structure.

Weight: 55 g/$m^2$

Knitting density: 32 C/25 W

Size of void: 20.4 $mm^2$

Number of voids: 30

A water-repellent knitted fabric was obtained by performing scouring, dyeing/water absorption processing (including drying), water repellent processing, and final set (FS) in accordance with the following formulation:

Scouring:

Scouring detergent (Sunmorl FL (NICCA CHEMICAL CO., LTD.), 1 g/L, 80° C.×20 min

Dyeing Processing:

Disperse dye (Dianix Black XF (DyStar), 3% omf (on weight of fiber)

Auxiliary agent (Nicca Sun Salt SN-130 (NICCA CHEMICAL CO., LTD.)), 0.5 g/L

Auxiliary agent (acetic acid), 0.2 cc/L

Water absorbent (SR-1000 (TAKAMATSU OIL & FAT CO., LTD.)), 1 g/L

Dyeing temperature: 130° C.×30 min

Drying: 120° C.×2 min

Water Repellent Processing:

Water repellent (LSE-009 (manufactured by Meisei Chemical Works, Ltd.)), 100 g/L Isocyanate-based crosslinking agent, Meikanate CS (Meisei Chemical Works, Ltd.), 10 g/L Melamine-based crosslinking agent, Beckamine M-3 (DIC Corporation), 5 g/L Amine salt-based catalyst, Catalyst ACX (DIC Corporation), 3 g/L Final set: drying: 170° C.×1 min

Evaluation Results of Example 1

HL150: grade 3

Rate of change of value B between initial and HL120: −70.4%

Rate of change of 2HB value: 73.2%

Rate of change of MIU: 4.9%

Rate of change of MMD: 10.1%

Sensory evaluation of texture: 4.0

Amount of water repellent adhered: 1.7 g/$m^2$

Water drainage: 86.2%

Bursting Strength: 303 kPa

Laundering durability, texture and Water drainage were good, and strength (Bursting Strength) was adequate for wearing.

Example 2

A water-repellent knitted fabric was obtained under the same conditions as those of Example 1 except that the weight, the knitting density, the size of a void, and the number of voids were changed as follows.

Weight: 50 g/$m^2$

Knitting density: 32 C/23 W

Size of void: 17.3 $mm^2$

The number of voids: 32

Evaluation Results of Example 2

HL150: grade 3

Rate of change of value B between initial and HL120: −53.7%

Rate of change of 2HB value: 53.2%

Rate of change of MIU: 4.2%

Rate of change of MMD: 11.5%

Sensory evaluation of texture: 3.6

Amount of water repellent adhered: 1.5 g/m$^2$

Water drainage: 85.4%

Bursting Strength: 307 kPa

Laundering durability, texture and Water drainage were good, and strength (Bursting Strength) was adequate for wearing.

Example 3

A water-repellent knitted fabric was obtained under the same conditions as those of Example 1 except that a false-twisted yarn (78 dtex, 48 filaments) including a polyester filament having single fibers with a triangle cross-section and a polyester filament having single fibers with a cross-shaped cross-section in a mass ratio of 50/50 was used, and that the weight, the knitting density, the size of a void, and the number of voids were changed as follows.

Weight: 60 g/m$^2$

Knitting density: 32 C/23 W

Size of void: 23.0 mm$^2$

Number of voids: 32

Evaluation Results of Example 3

HL150: grade 3

Rate of change of value B between initial and HL120: −51.0%

Rate of change of 2HB value: 43.5%

Rate of change of MIU: 4.8%

Rate of change of MMD: 9.4%

Sensory evaluation of texture: gentleness: 3.4, smoothness: 3.8

Amount of water repellent adhered: 1.9 g/m$^2$

Water drainage: 84.1%

Bursting Strength: 290 kPa

Laundering durability, texture and Water drainage were good, and strength (Bursting Strength) was adequate for wearing.

Example 4

A knitted fabric having a weight, a knitting density, a size of a void, and the number of voids as described below was obtained by using a false-twisted yarn of a polyester filament having single fibers with a circular cross-section (84 dtex, 72 filaments). The knitted fabric was subjected to scouring, dyeing processing (including drying), water repellent processing, and final set (FS) in accordance with the above-described formulation to obtain a water-repellent knitted fabric. In the dyeing processing, a water absorbent was not used.

Weight: 75 g/m$^2$

Knitting density: 32 C/25 W

Size of void: 20.4 mm$^2$

Number of voids: 30

Evaluation Results of Example 4

HL120: grade 3

Rate of change of value B between initial and HL120: −50.0%

Rate of change of 2HB value: 44.3%

Rate of change of MIU: 4.3%

Rate of change of MMD: 5.4%

Sensory evaluation of texture: 3.4

Amount of water repellent adhered: 2.2 g/m$^2$

Water drainage: 75.4

Bursting Strength: 270 kPa

Laundering durability, texture and Water drainage were good, and strength (Bursting Strength) was adequate for wearing.

Example 5

A mesh knitted fabric having a weight, a knitting density, a size of a void, and the number of voids as described below was produced by using a false-twisted yarn of Lumiace 73T44 used in Example 1.

Weight: 55 g/m$^2$

Knitting density: 33 C/24 W

Size of void: 20.4 mm$^2$

Number of voids: 31

A water-repellent knitted fabric was obtained from this knitted fabric under the same conditions as those of Example 1 except that the formulation of the water repellent processing was changed as follows (the amount of the water repellent was doubled), and that the dyeing processing was performed without using a water absorbent.

Water Repellent Processing:

Water repellent: LSE-009, 200 g/L

Isocyanate-based crosslinking agent: Meikanate CX, 20 g/L

Melamine-based crosslinking agent: Beckamine M-3, 10 g/L

Amine salt-based catalyst: Catalyst ACX, 6 g/L

Evaluation Results of Example 5

HL120: grade 3

Rate of change of value B between initial and HL120: −53.4%

Rate of change of 2HB value: 65.3%

Rate of change of MIU: 5.0%

Rate of change of MMD: 9.8%

Sensory evaluation of texture: gentleness: 3.2, smoothness: 4.0

Amount of water repellent adhered: 3.5 g/m$^2$

Water drainage: 79.0%

Bursting Strength: 273 kPa

Laundering durability, texture and Water drainage were good, and strength (Bursting Strength) was adequate for wearing.

Example 6

A water-repellent knitted fabric was obtained under the same conditions as those of Example 1 except that a constituent fiber was changed to a false-twisted fiber of Lumiace UV (polyester multifilament having single fibers with a modified cross-section, 84 dtex, 48 filaments, manufactured by UNITIKA TRADING CO., LTD.), and that a mesh structure having a weight, a knitting density, a size of a void, and the number of voids as described below was employed.

Weight: 75 g/m$^2$
Knitting density: 32 C/25 W
Size of void: 20.4 mm$^2$
Number of voids: 30

Evaluation Results of Example 6

HL150: grade 3
Rate of change of value B between initial and HL120: −54.8%
Rate of change of 2HB value: 72.5%
Rate of change of MIU: 4.7%
Rate of change of MMD: 10.2%
Sensory evaluation of texture: gentleness: 3.8, smoothness: 3.2
Amount of water repellent adhered: 2.4 g/m$^2$
Water drainage: 77.2%
Bursting Strength: 279 kPa
Laundering durability, texture and Water drainage were good, and strength (Bursting Strength) was adequate for wearing.

Example 7

A water-repellent knitted fabric was obtained under the same conditions as those of Example 1 except that a constituent fiber was changed to a blended fiber (92 dtex, 70 filaments) of Lumiace 73T44 and a polyester multifilament having single fibers with a triangle cross-section (19 dtex, 26 filaments), and that a mesh structure having a weight, a knitting density, a size of a void, and the number of voids as described below was employed.
Weight: 70 g/m$^2$
Knitting density: 32 C/23 W
Size of void: 23.0 mm$^2$
Number of voids: 32

Evaluation Results of Example 7

HL150: grade 3
Rate of change of value B between initial and HL120: −51.3%
Rate of change of 2HB value: 64.2%
Rate of change of MIU: 4.5%
Rate of change of MMD: 11.8%
Sensory evaluation of texture: gentleness: 3.4, smoothness: 3.6
Amount of water repellent adhered: 2.2 g/m$^2$
Water drainage: 84.5%
Bursting Strength: 315 kPa
Laundering durability, texture and Water drainage were good, and strength (Bursting Strength) was adequate for wearing.

Example 8

A mesh knitted fabric having a weight, a knitting density, a size of a void, and the number of voids as described below was obtained by using a blended yarn of a nylon multifilament having single fibers with a circular cross-section (33 dtex, 26 filaments) and a polyurethane monofilament (78 dtex). Then, a water-repellent knitted fabric was obtained under the same conditions as those of Example 1 except that the dyeing processing was performed without using a water absorbent.
Weight: 95 g/m$^2$
Knitting density: 75 C/52 W
Size of void: 7.9 mm$^2$
Number of voids: 23

Evaluation Results of Example 8

HL120: grade 3
Rate of change of value B between initial and HL120: −14.3%
Rate of change of 2HB value: −9.1%
Rate of change of MIU: 14.0%
Rate of change of MMD: 28.5%
Sensory evaluation of texture: 4.0
Amount of water repellent adhered: 2.7 g/m$^2$
Water drainage: 90%
Bursting Strength: 203 kPa
Laundering durability, texture and Water drainage were good, and strength (Bursting Strength) was adequate for wearing.

Example 9

A knitted fabric having a weight, a knitting density, a size of a pore, and the number of voids as described below was obtained, and a water-repellent knitted fabric was obtained under the same conditions as those of Example 1 except that the dyeing processing was performed without using a water absorbent.
Weight: 55 g/m$^2$
Knitting density: 33 C/23 W
Size of void: 15.1 mm$^2$
Number of voids: 33

Evaluation Results of Example 9

HL100: grade 3
Rate of change of value B between initial and HL120: −49.9%
Rate of change of 2HB value: 43.7%
Rate of change of MIU: 5.5%
Rate of change of MMD: 13.8%
Sensory evaluation of texture: 3.8
Amount of water repellent adhered: 1.7 g/m$^2$
Water drainage: 75.7%
Bursting Strength: 292 kPa
Laundering durability, texture and Water drainage were good, and strength (Bursting Strength) was adequate for wearing.

Comparative Example 1

A water-repellent knitted fabric was obtained under the same conditions as those of Example 1 except that the weight, the knitting density, the size of a void, and the number of the voids of a mesh knitted fabric were changed as follows.
Weight: 90 g/m$^2$
Knitting density: 67 C/19 W
Size of void: 6.4 mm$^2$
Number of voids: 52

Evaluation Results of Comparative Example 1

HL150: grade 3
Rate of change of value B between initial and HL120: −41.2%
Rate of change of 2HB value: 65.7%
Rate of change of MIU: 1.6%

Rate of change of MMD: 6.6%

Sensory evaluation of texture: gentleness: 0.7, smoothness: 2.0

Amount of water repellent adhered: 2.7 g/m$^2$

Water drainage: 64.8%

Bursting Strength: 323 kPa

Although the Water drainage was poor because of a small size of the voids, the Bursting Strength was excellent. The initial flexural rigidity B value was 0.0391 gf·cm$^2$/cm, the 2HB value was as high as 0.0130 gf·cm/cm, and the bounce was strong. Besides, the initial MIU value and MMD value were large, the surface was rough, and the sensory evaluation of the texture was poor.

Comparative Example 2

A water-repellent knitted fabric was obtained under the same conditions as those of Example 1 except that the weight, the knitting density, the size of a void, and the number of the voids of a mesh knitted fabric were changed as follows.

Weight: 40 g/m$^2$

Knitting density: 37 C/15 W

Size of void: 34.6 mm$^2$

Number of voids: 25

Evaluation Results of Comparative Example 2

HL150: grade 3

Rate of change of value B between initial and HL120: −44.7%

Rate of change of 2HB value: 65.4%

Rate of change of MIU: 6.1%

Rate of change of MMD: 14.6%

Sensory evaluation of texture: gentleness: 4.0, smoothness: 2.0

Amount of water repellent adhered: 1.0 g/m$^2$

Water drainage: 95.3%

Bursting Strength: 153 kPa

Since the size of the voids was large and the thickness was small, the Water drainage was good, but since the density and thickness were small, the Bursting Strength was low, and was not adequate for wearing. Besides, the rate of change of MIU was high, and change in the texture caused by laundering was large.

Comparative Example 3

A water-repellent knitted fabric was obtained under the same conditions as those of Example 1 except that the weight, the knitting density, the size of a void, and the number of the voids of a mesh knitted fabric were changed as follows.

Weight: 95 g/m$^2$

Knitting density: 75 C/52 W

Size of void: 9.4 mm$^2$

Number of voids: 12

Evaluation Results of Comparative Example 3

HL120: grade 3

Rate of change of value B between initial and HL120: −13.6%

Rate of change of 2HB value: −10.2%

Rate of change of MIU: 5.6%

Rate of change of MMD: 21.7%

Sensory evaluation of texture: 4.0

Amount of water repellent adhered: 2.8 g/m$^2$

Water drainage: 69.3%

Bursting Strength: 210 kPa

The Water drainage was good in spite of the small number of voids, the texture was good, but the rate of change of MMD was large, and change in the texture caused by laundering was large.

Comparative Example 4

A water-repellent knitted fabric was obtained under the same conditions as those of Example 9 except that the weight, the knitting density, the size of a void, and the number of the voids of a mesh knitted fabric were changed as follows.

Weight: 70 g/m$^2$

Knitting density: 52 C/30 W

Size of void: 11.8 mm$^2$

Number of voids: 60

Evaluation Results of Comparative Example 4

HL100: grade 3

Rate of change of value B between initial and HL120: −63.5%

Rate of change of 2HB value: 57.6%

Rate of change of MIU: 4.4%

Rate of change of MMD: 9.8%

Sensory evaluation of texture: 4.0

Amount of water repellent adhered: 2.1 g/m$^2$

Water drainage: 68.1%

Bursting Strength: 353 kPa

Although the size of the void was in a good range, the number of the voids was large.

Comparative Example 5

A water-repellent knitted fabric was obtained under the same conditions as those of Example 1 except that a blended yarn of a false-twisted yarn of a polyester filament having single fibers with a circular cross-section (110 dtex, 48 filaments) and a polyester filament having single fibers with a circular cross-section (44 dtex, 48 filaments) was used to obtain a mesh knitted fabric having the following structure, and that the dyeing processing was performed without using a water absorbent.

Weight: 240 g/m$^2$

Knitting density: 32 C/49 W

Size of void: 75.3 mm$^2$

Number of voids: 35

Evaluation Results of Comparative Example 5

HL100: grade 3

Rate of change of value B between initial and HL120: −10.4%

Rate of change of 2HB value: 10.8%

Rate of change of MIU: 4.5%

Rate of change of MMD: 30.4%

Sensory evaluation of texture: 0.0

Amount of water repellent adhered: 9.5 g/m$^2$

Water drainage: 84.6%

Bursting Strength: 530 kPa

The weight and the thickness were large, the initial flexural rigidity value B was 0.0464 gf·cm$^2$/cm, and the 2HB value was as high as 0.0715 gf·cm/cm, and the bounce was strong. Besides, the result of the sensory evaluation of the texture was poor, the feeling of wearing as an innerwear was poor, and the Bursting Strength was high.

<JIS L-1092 Spray Method: Water Repellency Test (Spray Test)>

Take three test pieces approximately 200 mm×200 mm from the sample, attach the test pieces so as not to cause wrinkles to the test piece holding frame, align the center of the spray with the center of the holding frame using a water repellency test apparatus, and align the direction of the test pieces so that they are parallel to the flow of water.

Disperse 250 mL of water in a funnel over the specimen for a duration of 25-30 seconds.

Then, remove the holding frame from the base top, hold horizontally at one end thereof, the other end with the front side of the test piece facing downward lightly dropped water droplets hit a hard object once, further hold one end turned 180°, remove the excess water droplets by operating in the same manner as before.

The wetted state of the test piece while being attached to the holding frame is compared with a comparative sample in a wet state and judged.

Provided, however, that the intermediate rating shall not be applied.

The water repellency test (spraying test) is the same test procedure as ISO 4920.

<JIS L-1096 Method A: Bursting Strength>

The Bursting Strength is measured by the Mullen method.

a) Procedure

Five test specimens of about 150 mm×150 mm are taken from the sample, and the test specimen is grasped by a clamp with a Mullen low-pressure tester or a Mullen burst tester having an accuracy equal to or higher than that, with the surface of the test specimen facing up, applying a uniform tension so as not to cause wrinkling and sagging, and pressure is applied to measure the strength (kPa) of the rubber septum to penetrate the test specimen and the strength (kPa) of the rubber septum only at the time of rupture.

b) Determine the Bursting Strength (kPa) according to the following equation, calculate the average value, and round to three significant digits.

$$Bs=A-B$$

Where: Bs: Bursting Strength (kPa);

A: Strength (kPa) at which the rubber septum pierces the test piece;

B: Strength (kPa) of the rubber septum alone at break.

<Wash>

JISL0217: Washing is performed according to the method 103 described in 1995.

Using an electric household washing machine equipped with a centrifugal dehydrator as specified in JIS C 9606, add water with a liquid temperature of 40° C. to the water level line indicating the standard amount of water in the water tub of the test equipment, add and dissolve a laundry synthetic detergent (type 1 (weakly alkaline) as specified in JIS K 3371) at a rate equivalent to the standard amount, and use this as the washing liquid.

The sample and the load cloth are put into this washing liquid so that the bath ratio becomes 1:30, and the operation is started.

After treatment for 5 minutes, stop the operation, dehydrate the sample and the load cloth with a dehydrator, and then replace the washing liquid with fresh water at 30° C. or lower, and rinse and wash for 2 minutes at the same bath ratio.

After a 2 minutes rinse wash, stop the operation, dehydrate the sample and the load cloth, rinse again for 2 minutes, dehydrate, and dry in a state not directly affected by sunlight.

<JIS L1096 8. 4 Thickness A>

Thickness is measured at a fixed time (10 s) and constant pressure (0.07 kPa) using a depth meter (Peacock Test machine) at five different locations of the sample, and the mean is calculated and rounded to two digits below the decimal point.

The invention claimed is:

1. A water-repellent knitted fabric that is a knitted fabric which comprises a multifilament having more than one fiber made of a thermoplastic resin and has a water repellent imparted to a surface of the knitted fabric, and satisfies the following conditions (1) to (4):

(1) the number of voids between stitches of the knitted fabric is 20 to 40/[12 cm×12 cm], and the voids have a size of 7 $mm^2$ to 25 $mm^2$, wherein a knitting density of the knitted fabric is, in terms of the number of courses (C) in one inch, 20 to 40, and in terms of the number of wales (W) in one inch, 15 to 30, a weight of the knitted fabric is 45 $g/m^2$ to 110 $g/m^2$;

(2) initial water repellency measured in accordance with a spray method described in JIS L-1092 is at a grade 3 or higher;

(3) initial Water drainage is 70% or more; and (4) initial Bursting Strength measured in accordance with a method A described in JIS L-1096 is 200 kPa or more and 500 kPa or less.

2. The water-repellent knitted fabric according to claim 1, wherein the multifilament comprises a plurality of single fibers having different cross-sectional shapes, and each cross-sectional shape comprises one or more projections in an outer periphery in a cross-section taken in a vertical direction to a lengthwise direction of the single fiber.

3. The water-repellent knitted fabric according to claim 1, satisfying the following condition (5):

(5) an initial flexural rigidity B value is 0.0250 $gf \cdot cm^2/cm$ or less, and a 2HB value is 0.0110 gf·cm/cm or less.

4. The water-repellent knitted fabric according to claim 1, satisfying the following condition (6):

(6) water repellency measured in accordance with the spray method after performing home laundering 100 times in accordance with a method 103 described in JIS L-0217 is at a grade 3 or higher.

5. The water-repellent knitted fabric according to claim 1, wherein the water repellent is selected from the group consisting of a fluorine-based water repellent having a perfluoroalkyl group having 6 or less carbon atoms, a silicone-based water repellent, and a hydrocarbon-based water repellent, and mixtures thereof.

6. The water-repellent knitted fabric according to claim 1, wherein the water-repellent knitted fabric is formed by a mesh structure.

7. A method for producing the water-repellent knitted fabric according to claim 1, comprising:

subjecting the knitted fabric comprising a multifilament made of a thermoplastic resin, having a number of voids of 20 to 40/[12 cm×12 cm] between stitches, and having a size of the voids of 7 to 25 $mm^2$, to water absorption processing with a water absorbent, followed by water repellent processing with a water repellent.

8. Clothing to be in direct contact with the skin, made of the water-repellent knitted fabric according to claim 1.

9. Layering comprising the clothing according to claim 8, and at least one upper clothing to be directly layered on the clothing.

* * * * *